United States Patent [19]

Lucht et al.

[11] 3,978,810

[45] Sept. 7, 1976

[54] MOORING BUOY

[75] Inventors: Wilhelm Lucht, Nordenham; Gunter Ecke, Bremerhaven, both of Germany

[73] Assignee: Aktiengesellschaft "Weser", Bremen, Germany

[22] Filed: June 27, 1975

[21] Appl. No.: 591,064

Related U.S. Application Data

[63] Continuation of Ser. No. 444,240, Feb. 20, 1974, abandoned.

[30] Foreign Application Priority Data

Feb. 23, 1973 Germany ..... 2308999

[52] U.S. Cl. ..... 114/230; 9/8 P

[51] Int. Cl.[2] ..... B63B 21/00

[58] Field of Search ..... 9/8, 9; 114/230, 218

[56] References Cited

UNITED STATES PATENTS

| | | | |
|---|---|---|---|
| 2,955,626 | 10/1960 | Hartley | 9/8 P |
| 3,631,550 | 1/1972 | Bullen | 9/8 R |
| 3,668,725 | 6/1972 | Renz et al. | 9/8 R |
| 3,860,983 | 1/1975 | Furth et al. | 9/8 R |

*Primary Examiner*—Stephen G. Kunin
*Assistant Examiner*—Sherman D. Basinger
*Attorney, Agent, or Firm*—Michael J. Striker

[57] ABSTRACT

A buoy having a generally hollow float body and a control arrangement thereon for flooding regions in said body sufficiently to overcome the buoyancy of the buoy by the weight of the buoy. The buoy can be sunk at a predetermined speed, for example upon or during the approach of a ship which would otherwise collide with the buoy. An arrangement is also provided for subsequently reestablishing the full buoyancy of the buoy, and for thereby raising the buoy to the water level.

7 Claims, 4 Drawing Figures

FIG. 1
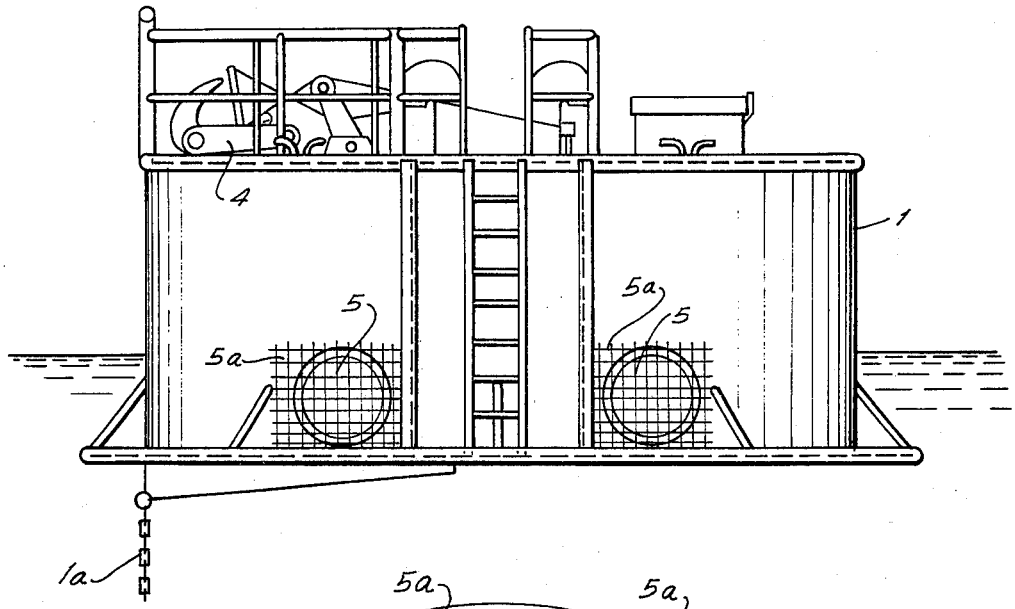
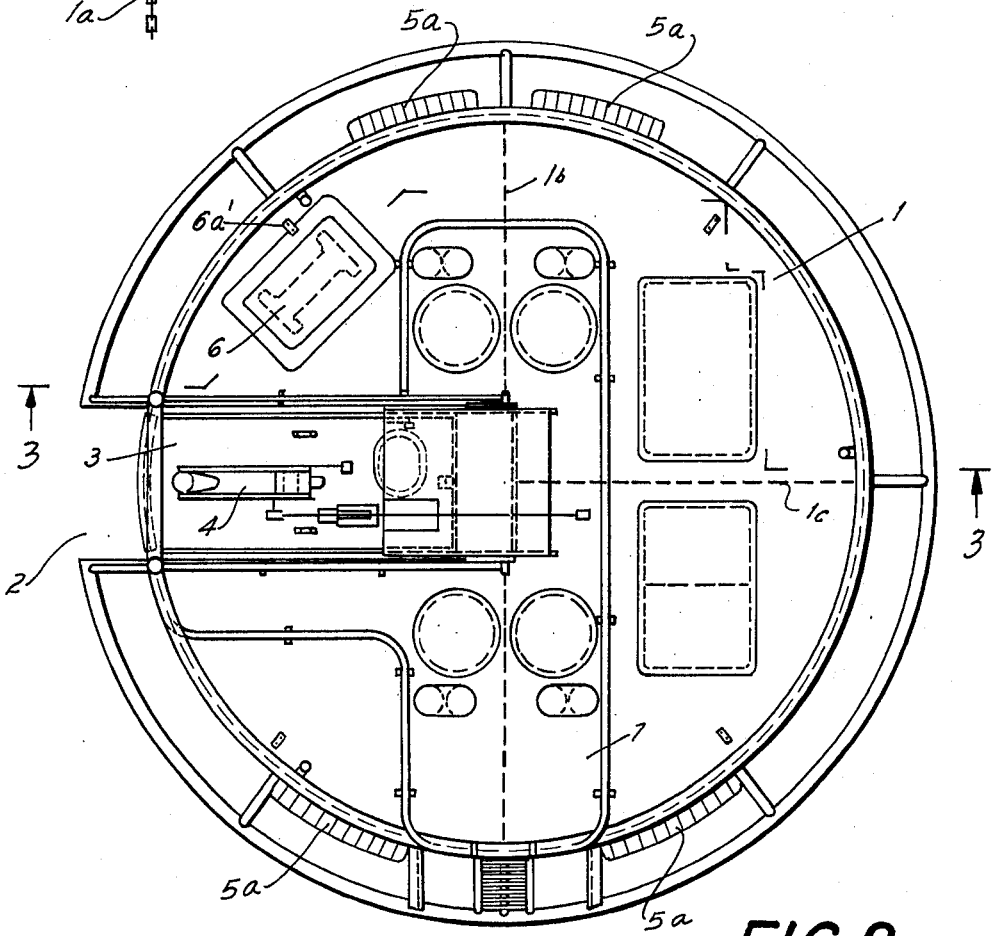
FIG. 2

MOORING BUOY

This is a continuation, of application Ser. No. 444,240, filed Feb. 20, 1974, and now abandoned.

BACKGROUND OF THE INVENTION

The mooring buoys known to persons skilled in the art are subject to substantial dangers caused by the motions of ships. Collisions frequently happen and lead to loss of the entire buoy, with expensive apparatus thereon. Also and most seriously such collisions jeopardize parts of the colliding ship such as the rudder or propeller or both. These difficulties are encountered mainly in narrow waters, and even when collisions are avoided the maneuvering of ships is frequently impaired by mooring buoys.

SUMMARY OF THE INVENTION

The invention avoids the former difficulties by providing a mooring buoy with a hollow float body and with control means for flooding sufficient part of the space in said hollow body to overcome the buoyancy of the buoy by the weight of the buoy, in the water. The control means advantageously include means for carrying out the flooding so as to cause the sinking of the buoy at a predetermined speed. For these purposes the buoy according to the invention is equipped with flooding valves, which may be operated manually, usually with the aid of mechanical, hydraulic or electric positioning members, but preferably under the control of a suitable radio-activated control system, whereby a plurality of buoys arranged in a certain area can be lowered simultaneously or individually in response to the approach of a ship.

It is further preferred to provide the mooring buoy with an auxiliary float, released from the top of the mooring buoy's body when the interior of this body is flooded, this auxiliary float then floating on the water surface. The release of the auxiliary float can be effected concurrently with the opening of the flooding valves, or preferably in response to actuation of a depth responsive release mechanism. The auxiliary float advantageously carries one end of a flexible control line means for the closing of the flood valves, and also carries one end of air hose means for pumping compressed air into the interior of the float body through the other end of the air hose means, for thereby removing the flooding water therefrom.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a side elevation of a mooring buoy according to the invention;

FIG. 2 is a plan view thereof; and

DESCRIPTION OF THE PREFERRED EMBODIMENT

Figure 3:
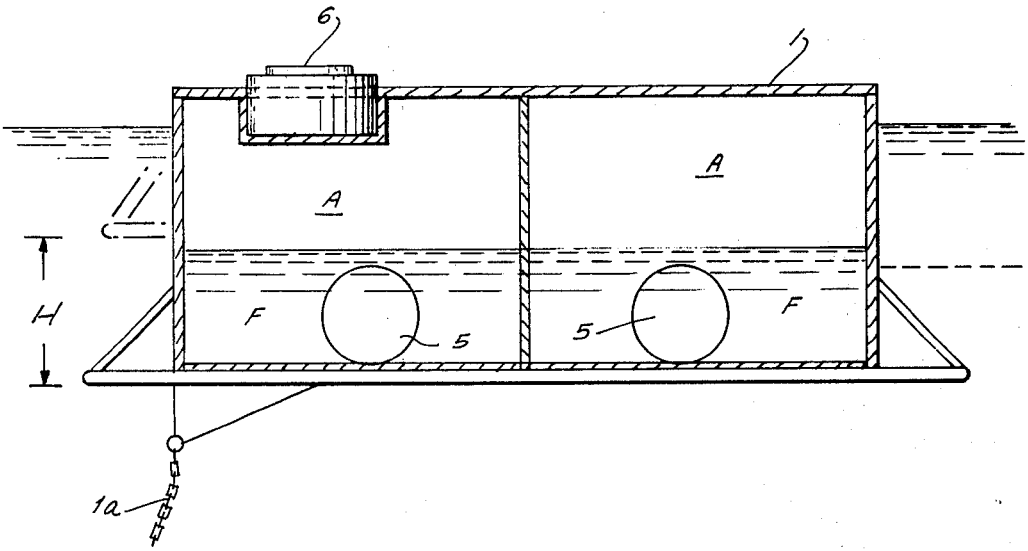
FIG. 3 and FIG. 4 show the apparatus of FIG. 1, in vertical central section, in different operative positions thereof.

The new mooring buoy has a generally hollow float body 1 shown as approximately cylindrical and having flat top and bottom walls. By means of chains 1*a* the float body 1 is normally anchored to a base (not shown) at the bottom of the sea. Also shown are mooring devices on the top of the buoy. These devices include a pivotable portion 3 disposed in a lateral recess 2 of the buoy and pivoted to the float body 1 by a horizontal axis 1*b*, as is known to persons skilled in the art. A releasable slip hook 4 is provided which is normally balanced by counterweight means (not shown) subject to rapid release. Various other devices for navigation can be installed on the top of the buoy, for manual operation or control by a person who may walk on the top.

In accordance with the invention the float body 1 has floodable regions or chambers in the generally hollow interior thereof, four such regions being indicated in FIG. 2, by broken lines, and each having, near the bottom of the buoy, flood valve means 5, each protected by a screen 5*a* to avoid the entrance of coarse impurities into the flooding chamber. Each valve 5 can be operated by manipulating means (not shown), for example it can be operated manually, or preferably by means of remote control means 7, known in the art, and schematically indicated in the drawing.

Also installed on the buoy is an auxiliary float 6, generally held thereto by holders 6*a*'. Instead, the auxiliary float 6 may lie on the top of the buoy in substantially loose condition and may simply remain on the water level when the buoy sinks. Preferably the holders 6*a*' are provided which can be released when the sinking buoy has reached a predetermined depth, as noted hereafter. Upon such release, the auxiliary float 6 rises to the water level.

Control means 7 are provided on the buoy to control the opening of the flood valves 5 thereby to admit water F to the buoy flooding chambers (FIG. 3), under the further control of suitable vent means (not shown), which influence the speed at which the air space A in the chamber is filled with flood water F. These controls also determine the speed at which the buoy sinks from its normal position (FIG. 1) to a certain depth H (FIG. 3). Also included in the control means 7, in the preferred embodiment of the invention, is a control member (not shown in detail as it may be of conventional construction by itself), which responds to the depth H or H' of submersion of the buoy, or to the level of flooding water F, F' or the pressure of overlying air A, A' in the buoy, to operate the holders 6*a*' and thereby to release the auxiliary float 6.

Figure 4:
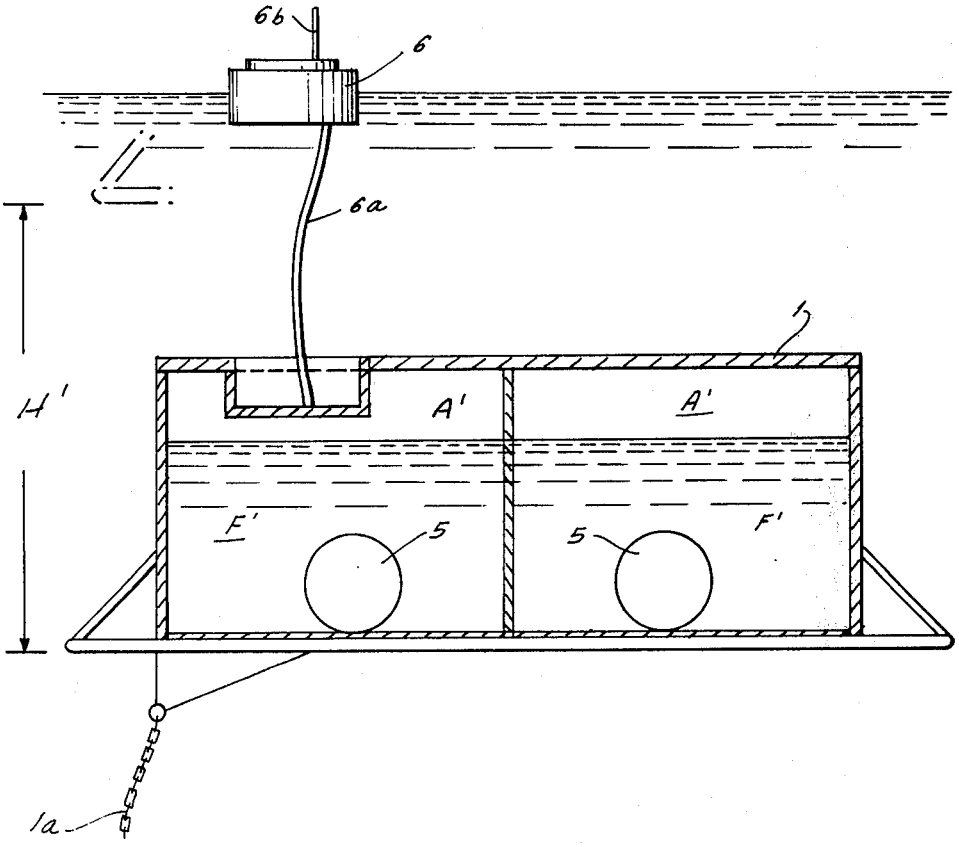

As shown in FIG. 4 the auxiliary float 6, in its released position, is connected with the buoy by flexible conduit means 6*a*. It will be understood that such flexible means can provide a plurality of service connections, including an air hose leading from one end thereof at the auxiliary float to another end in air space A', and an electric line for similarly connecting the control apparatus 7 with the float 6. By these arrangements it becomes possible to return the buoy to its raised position, for example from a boat, without the service of divers.

Controls 7 can include apparatus (not shown in detail) to operate the closure means of the flood valves 5, and the additional venting devices and the like in air space A. Advantageously further control means is provided on auxiliary float 6, which include radio receiver means 6*b* for the reception of signals, either from land or from ships, for triggering the buoy's control 7 and for thereby initiating automatic sinking of the buoy upon the approach of a ship, and resurfacing of the buoy when the ship has passed. It will be understood that each of the elements described above, or two or more together, may also find a useful application in other types of mooring buoys differing from the types described above.

While the invention has been illustrated and described as embodied in a mooring buoy, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. In an arrangement for anchoring watercraft floating on a body of water, a combination comprising anchor means disposable at the bottom of the body of water; variable buoyancy buoy means including a generally hollow float body provided with a recess; means for connecting said buoy means to said anchoring means; means for varying the buoyancy of said buoy means; means for actuating said varying means so as to submerge and surface said buoy means by varying the buoyancy thereof; mooring means including a mounting portion mounted in said recess of said float body for pivoting with respect to the latter about a substantially horizontal axis and a rapid-release slip hook on said mounting portion and operative for anchoring the watercraft thereto when said buoy means is surfaced and for releasing the watercraft during the submerging of said buoy means; an auxiliary float on said body, flexible conduit means connecting the auxiliary float with said body; means for normally holding said auxiliary float to said body; and pressure responsive means for automatically releasing the auxiliary float when said body has sunk to a predetermined depth.

2. A combination as defined in claim 1, wherein said flexible conduit means comprises air hose means, connected with the hollow interior of said body.

3. A combination as defined in claim 1, also including radio means for receiving signals and for controlling said varying means.

4. A combination as defined in claim 3, wherein said auxiliary float carriers at least part of the radio means.

5. A combination as defined in claim 1, wherein said varying means includes flood valve means for flooding regions of said hollow float body and actuated by said actuating means so as to admit a sufficient quantity of water into said regions for submerging said float body.

6. A combination as defined in claim 5, wherein said flood valve means is movable between an open and a closed position, and wherein said flexible conduit means comprises control conduit means for controlling the position of said flood valve means.

7. A combination as defined in claim 1, wherein said varying means further comprises means for expelling water from regions of said hollow float body and actuated by said actuating means so as to expel a sufficient quantity of water from said regions for surfacing said float body.

* * * * *